US010520840B2

(12) United States Patent
Veregin et al.

(10) Patent No.: US 10,520,840 B2
(45) **Date of Patent: *Dec. 31, 2019**

(54) COLD PRESSURE FIX TONER COMPOSITIONS BASED ON SMALL MOLECULE CRYSTALLINE AND AMORPHOUS ORGANIC COMPOUND MIXTURES

(71) Applicant: XEROX CORPORATION, Norwalk, CT (US)

(72) Inventors: Richard Philip Nelson Veregin, Mississauga (CA); Nan-Xing Hu, Oakville (CA); Guerino G. Sacripante, Oakville (CA); Karen A. Moffat, Brantford (CA); Jennifer L. Belelie, Oakville (CA)

(73) Assignee: XEROX CORPORATION, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/874,292

(22) Filed: Jan. 18, 2018

(65) Prior Publication Data

US 2018/0143548 A1 May 24, 2018

Related U.S. Application Data

(62) Division of application No. 14/802,949, filed on Jul. 17, 2015, now Pat. No. 9,910,373.

(51) Int. Cl.

| | |
|---|---|
| ***G03G 9/08*** | (2006.01) |
| ***G03G 9/087*** | (2006.01) |
| ***G03G 15/20*** | (2006.01) |

(52) U.S. Cl.

CPC ..... *G03G 9/0821* (2013.01); *G03G 9/08775* (2013.01); *G03G 9/08782* (2013.01); *G03G 9/08795* (2013.01); *G03G 9/08797* (2013.01); *G03G 15/2092* (2013.01)

(58) Field of Classification Search

USPC ..... 525/165

See application file for complete search history.

(56) References Cited

U.S. PATENT DOCUMENTS

| | | | |
|---|---|---|---|
| 4,935,324 | A | 6/1990 | Grushkin et al. |
| 5,013,630 | A | 5/1991 | Ong et al. |
| 5,023,159 | A | 6/1991 | Ong et al. |
| 5,231,135 | A | 7/1993 | Machell et al. |
| 5,283,153 | A | 2/1994 | Sacripante et al. |
| 5,621,022 | A | 4/1997 | Jaeger et al. |
| 5,965,313 | A | 10/1999 | Mizutani et al. |
| 6,221,137 | B1 | 4/2001 | King et al. |
| 6,472,523 | B1 | 10/2002 | Banning et al. |
| 6,476,219 | B1 | 11/2002 | Duff et al. |
| 6,576,747 | B1 | 6/2003 | Carlini et al. |
| 6,576,748 | B1 | 6/2003 | Carlini et al. |
| 6,590,082 | B1 | 7/2003 | Banning et al. |
| 6,646,111 | B1 | 11/2003 | Carlini et al. |
| 6,663,703 | B1 | 12/2003 | Wu et al. |
| 6,673,139 | B1 | 1/2004 | Wu et al. |
| 6,696,552 | B2 | 2/2004 | Mayo et al. |
| 6,713,614 | B2 | 3/2004 | Carlini et al. |
| 6,726,755 | B2 | 4/2004 | Titterington et al. |
| 6,755,902 | B2 | 6/2004 | Banning et al. |
| 6,821,327 | B2 | 11/2004 | Wayne et al. |
| 6,958,406 | B2 | 10/2005 | Banning et al. |
| 7,053,227 | B2 | 5/2006 | Jaeger et al. |
| 7,381,831 | B1 | 6/2008 | Banning et al. |
| 7,427,323 | B1 | 9/2008 | Birau et al. |
| 8,541,153 | B2 | 9/2013 | Matsumura |
| 8,747,535 | B1 | 6/2014 | Chopra et al. |
| 2012/0183897 | A1 | 7/2012 | Farrugia et al. |
| 2013/0131226 | A1 | 5/2013 | Goredema et al. |
| 2014/0377700 | A1 | 12/2014 | Mine et al. |
| 2017/0017170 | A1 | 1/2017 | Veregin et al. |

OTHER PUBLICATIONS

Journal of the Imaging Society of Japan [Nihon Gazo Gakkaishi]; 43(1) 2004:48-53, ; SPSS (Spherical Polyester Toner by Suspension of Polymer/Pigment Solution and Solvent Removal Method.

*Primary Examiner* — Terressa Boykin

(74) *Attorney, Agent, or Firm* — Pillsbury Winthrop Shaw Pittman LLP

(57) ABSTRACT

A cold pressure fix toner composition includes at least one $C_{16}$ to $C_{80}$ crystalline organic material having a melting point in a range from about 30° C. to about 130° C. and at least one $C_{16}$ to $C_{80}$ amorphous organic material having a Tg of from about −30° C. to about 70° C. A method of cold pressure fix toner application includes providing the cold pressure fix toner composition, disposing the cold pressure fix toner composition on a substrate and applying pressure to the disposed composition on the substrate under cold pressure fixing conditions. The cold pressure fix toner compositions can be formed into latexes.

20 Claims, 2 Drawing Sheets

COLD PRESSURE FIX TONER COMPOSITIONS BASED ON SMALL MOLECULE CRYSTALLINE AND AMORPHOUS ORGANIC COMPOUND MIXTURES

CROSS-REFERENCE TO RELATED APPLICATIONS

This application is a divisional application of co-pending U.S. patent application Ser. No. 14/802,949, filed Jul. 17, 2015, which is herein incorporated by reference in its entirety.

BACKGROUND

The present disclosure relates to toner compositions for use in xerography. In particular, the present disclosure relates to cold pressure fix toner compositions.

Cold pressure fix toners normally operate in a system employing a pair of high-pressure rollers to fix toner to paper without heating. Among the advantages of such systems are the use of low power and little paper heating. One example of a cold pressure fix toner comprises predominantly wax an ethylene-vinyl acetate copolymer with softening point of 99° C., and a 120° C. softening point polyamide thermoplastic polymer. An example of this approach is shown in U.S. Pat. No. 4,935,324, which is incorporated herein by reference. Another example of a cold pressure fix toner is comprised of a copolymer of styrene with 1-tertiary-butyl-2-ethenyl benzene and a polyolefin wax exemplified for example as Xerox 4060 cold pressure fix toner. Other cold fix toners have been based on a long chain acrylate core produced by suspension polymerization, such as lauryl acrylate. Examples of such compositions are disclosed in U.S. Pat. Nos. 5,013,630 and 5,023,159 which are incorporated herein by reference. Such systems are designed to have a core with a $T_g$ less than room temperature. A hard shell, such as polyurethane prepared by an interfacial polymerization, is disposed about the core in order to keep the liquid content in the core in the toner particle.

Performance issues in designs with high wax content include that they work only at high pressure, such as about 2000 psi or even 4000 psi, which are respectively, 140 kgf/cm$^2$ and 280 kgf/cm$^2$ and even then image robustness can be poor. In the case of long chain acrylate core designs the shell needs to be very thin to break under pressure, but it can be very challenging to prevent the capsules from leaking because the core is typically a liquid at room temperature.

SUMMARY

In some aspects, embodiments herein relate to cold pressure fix toner compositions comprising at least one C16 to C80 crystalline organic material having a melting point in a range from about 30° C. to about 130° C. and at least one C16 to C80 amorphous organic material having a Tg of from about −30° C. to about 70° C.

In other aspects, embodiments herein relate to methods of cold pressure fix toner application comprising providing a cold pressure fix toner composition comprising at least one C16 to C80 crystalline organic material having a melting point in a range from about 30° C. to about 130° C. and at least one C16 to C80 amorphous organic material ester having a Tg of from about 0° C. to about 60° C., disposing the cold pressure fix toner composition on a substrate and applying pressure to the disposed composition on the substrate under cold pressure fixing conditions.

In still further aspects, embodiment herein relate to latexes formed from a cold pressure fix toner composition comprising at least one C16 to C80 crystalline amorphous material having a melting point in a range from about 30° C. to about 130° C.; and at least one C16 to C80 amorphous rosin ester having a Tg of from about −30° C. to about 60° C.

BRIEF DESCRIPTION OF DRAWINGS

Various embodiments of the present disclosure will be described herein below with reference to the figures wherein.

DETAILED DESCRIPTION

Figure 1:
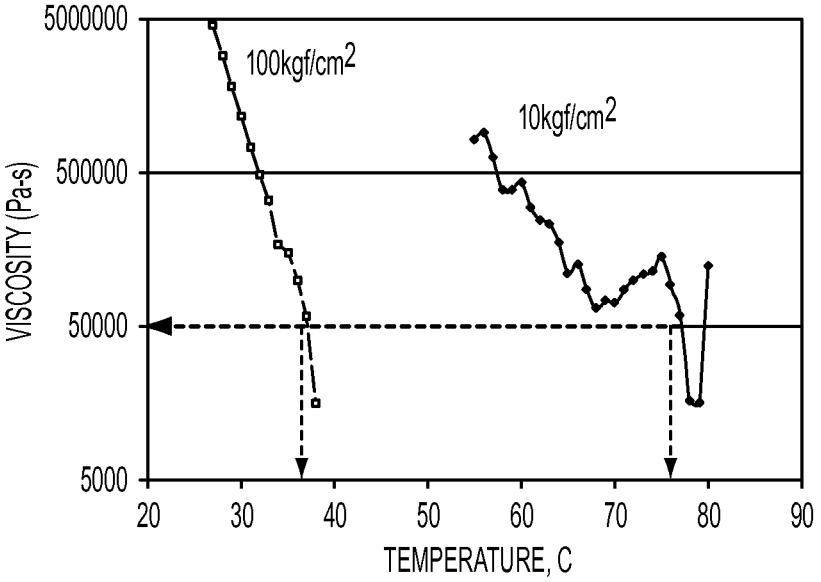
FIG. 1 shows the Shimadzu flow tester viscosity with temperature plot for an exemplary mixture of a crystalline ester distearyl terephthalate and an amorphous polyterpene resin SYLVARES™ TR A25 in a 79/21 wt % ratio for cold pressure fix application. At low pressure of 10 kgf/cm$^2$ the transition temperature to reach a viscosity of $10^4$ Pa-s is 77° C., while at a high pressure of 100 kgf/cm$^2$ the transition temperature to reach a viscosity of $10^4$ Pa-s is 38° C. The shift in the transition temperature to reach a viscosity of $10^4$ Pa-s is 39° C. between a pressure of 10 kgf/cm$^2$ and 100 kgf/cm$^2$
Figure 2A:
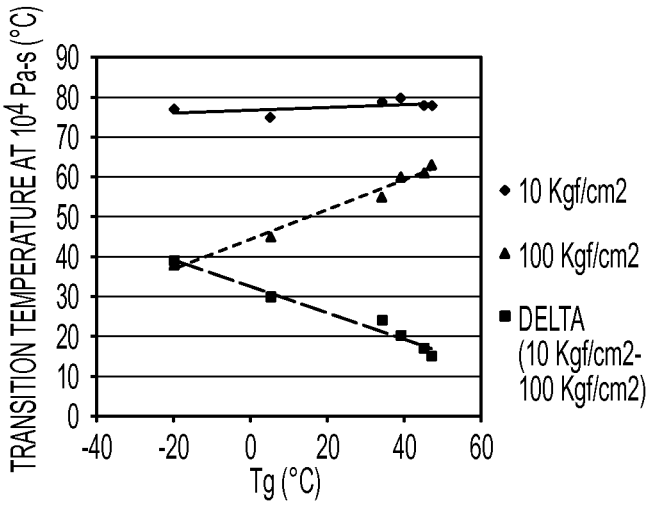
FIG. 2A shows the Shimadzu flow tester transition temperatures for an exemplary mixture of a crystalline ester distearyl terephthalate with varying amorphous Tg for different amorphous small molecule organic materials at a 79/21 wt % ratio. Shown are transitions temperatures to reach $10^4$ Pa-s at 10 kgf/cm$^2$, at 100 kgf/cm$^2$ and the difference in the transition temperatures to reach $10^4$ Pa-s at 10 kgf/cm$^2$ minus that at 100 kgf/cm$^2$.
Figure 2B:
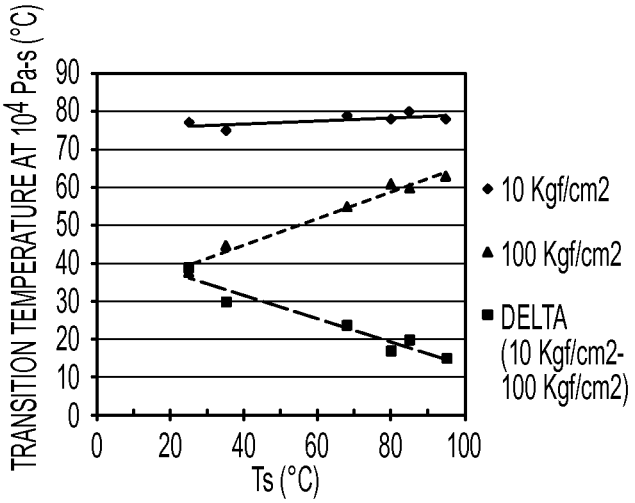
FIG. 2B shows a plot with the same materials as FIG. 2A and transition temperatures as in FIG. 1, but showing the effect of different Ts of the different amorphous small molecules.
Figure 3:
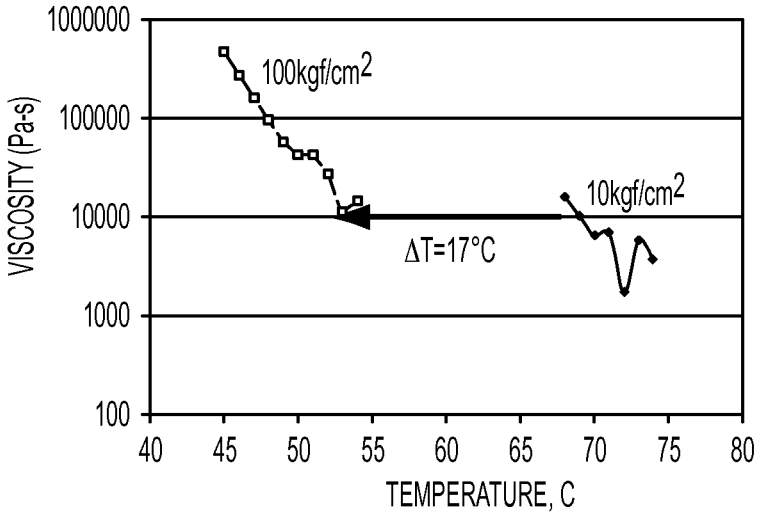
FIG. 3 shows the Shimadzu results for an exemplary mixture of a crystalline polyester polymer with an amorphous small molecule polyterpene resin SYLVARES™TR A25 in 79/21 wt % ratio.

Embodiments herein provide cold pressure fix toners that comprise at least one crystalline organic compound which may be a small molecule or organic polymer, either of which is coupled with at least one amorphous organic small molecule or organic oligomeric resin. The crystalline and amorphous components are mixed together to provide a material that undergoes a phase change from solid to liquid at modest temperature, such as about 20° C. to about 70° C. at a pressure as low as 25 kgf/cm$^2$ to about 100 kgf/cm$^2$ to about 400 kgf/cm$^2$. In embodiments there are provided cold pressure fix toners that comprise at least one crystalline small molecule, such as a crystalline small molecule ester for example, and at least one amorphous organic molecule or resin composition, or in embodiments at least one amorphous organic small molecule or organic oligomeric resin composition. The crystalline and amorphous small molecules are mixed together to provide a material that undergoes a phase change from solid to liquid at modest temperature, such as about 20° C. to about 70° C. at a pressure as low as 25 kgf/cm$^2$ to about 100 kgf/cm$^2$ to about 400 kgf/cm$^2$. In some embodiments, the cold pressure fix toners may comprise a solid ink design employed in solid inkjet printing. While solid inkjet inks typically operate by heating above 100° C., it has been surprisingly found that under pressure these materials exhibit desirable flow near room temperature, and thus are ideal for cold pressure fix toner applications.

In embodiments there are provided cold pressure fix toners that comprise at least one crystalline polyester resin and at least one amorphous organic small molecule or organic oligomeric resin composition. The crystalline polyester resin and amorphous small molecules are mixed together to provide a material that undergoes a phase change from solid to liquid at modest temperature, such as about 20° C. to about 70° C. at a pressure as low as 25 kgf/cm$^2$ to about 100 kgf/cm$^2$ to about 400 kgf/cm$^2$.

As used herein, a "small molecule" or oligomeric resin has less than about 80 carbon atoms and less than about 100 carbon and oxygen atoms combined.

In embodiments, there are provided cold pressure fix toner compositions comprising at least one crystalline organic material, such as a crystalline ester or crystalline polyester, having a melting point in a range from about 30° C. to about 130° C. and at least one C16 to C80 amorphous small molecule or oligomeric resin having a $T_g$ of from about −30° C. to about 70° C.

In embodiments, there are provided cold pressure fix toner compositions comprising at least one $C_{16}$ to $C_{80}$ crystalline organic material, such as a crystalline ester, having a melting point in a range from about 30° C. to about 130° C. and at least one amorphous molecule or resin having a Tg of from about −30° C. to about 70° C., or in embodiments at least one $C_{16}$ to $C_{80}$ amorphous small molecule or oligomeric resin having a $T_g$ of from about −30° C. to about 70° C.

As used herein, "small molecule" refers to an organic compound, i.e., one containing at least carbon and hydrogen atoms, and having a molecule weight less than 2,000 daltons, or less than 1,500 daltons, or less than 1,000 daltons, or less than 500 daltons.

As used herein, "cold pressure fix toner" or "CPF toner" refers to a toner material designed for application to a substrate and which is affixed to the substrate primarily by application of pressure. While heating may be optionally employed to assist in fixing a CPF toner, one benefit of the compositions disclosed herein is the ability to used reduced heating, or in embodiments, no applied heating. Affixing by application of pressure may be achieved in a broad range of pressures, such as from about 50 kgf/cm$^2$ to about 100 kgf/cm$^2$ to about 200 kgf/cm$^2$. If necessary it is possible to use higher pressures up to about 400 kgf/cm$^2$, however, generally such higher pressures are undesirable, causing calendaring and even wrinkling of the paper which distorts the look and feel of the paper, and requires more robust pressure fix rolls and spring assemblies.

In embodiments, the CPF toner comprises at least one crystalline ester. In some such embodiments, the CPF toner comprises a crystalline diester. In embodiments, the at least one crystalline ester comprises an optionally substituted phenyl or benzyl ester. In embodiments, the at least one crystalline ester comprises distearyl terephthalate (DST).

In embodiments, suitable crystalline esters may be diesters from about $C_{16}$ to $C_{80}$, with melting points in a range from about 30° C. to about 130° C., such as those shown in the examples below in Table 1.

In embodiments, it may be desirable to incorporate one or more acid groups, such as carboxylate or sulfonate, in these materials to provide negative charge to enhance toner performance. These acid groups may also be useful so the materials may be employed in the emulsion/aggregation toner processing. In embodiments, the acid moiety may be disposed in any position on the aromatic residues of the compounds in Table 1. In other embodiments, the acid may be provided by including some amount of monoester in place of the diester so that one end of the molecule bears an acid moiety.

TABLE 1

| Structure | $T_{melt}$ (° C.) | $T_{crys}$ (° C.) | $T_g$ (° C.) |
|---|---|---|---|
| 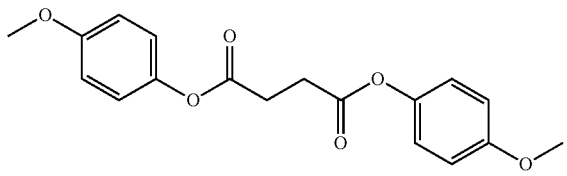 | 94 | 47 | n/a |
| 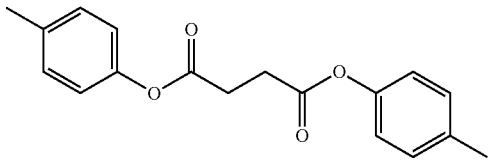 | 115 | 62 | n/a |
| 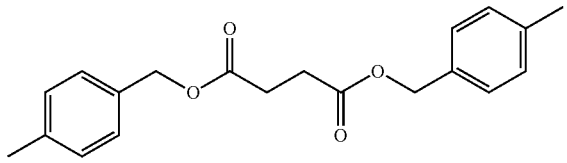 | 74 | ~50 | n/a |

TABLE 1-continued
| Structure | $T_{melt}$ (° C.) | $T_{crys}$ (° C.) | $T_g$ (° C.) |
|---|---|---|---|
| 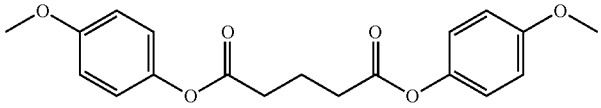 | 102 | 51 | n/a |
| 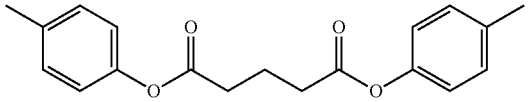 | 86 | 34 | n/a |
| 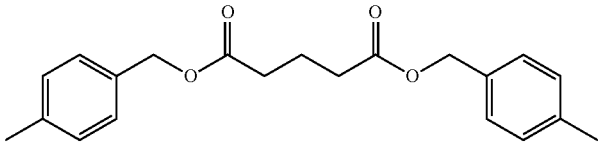 | 35 | n/a | n/a |
| 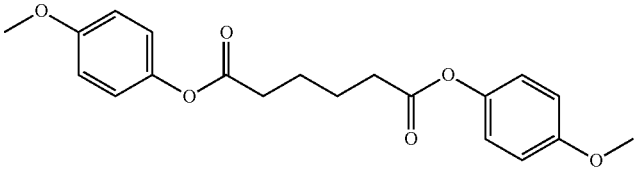 | 127 | 75 | n/a |
| 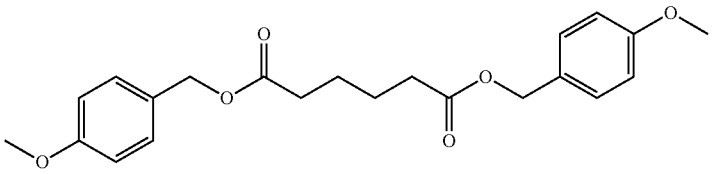 | 59 | 20-26 | n/a |
| 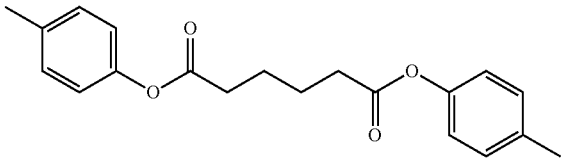 | 100 | 62 | n/a |
| 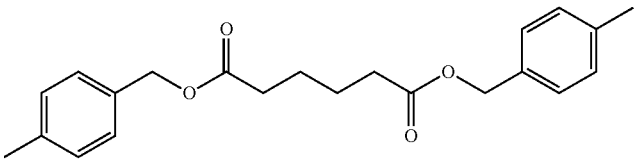 | 56 | −5 | n/a |
| 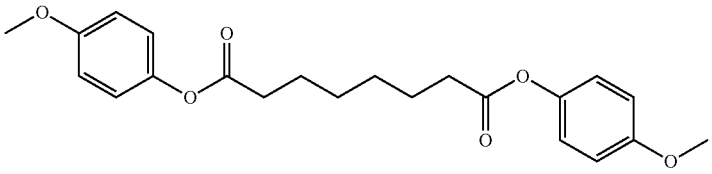 | 119 | ~75 | n/a |
| 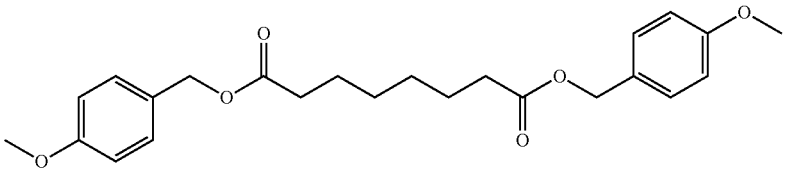 | 80 | 18 | n/a |

TABLE 1-continued

| Structure | $T_{melt}$ (° C.) | $T_{crys}$ (° C.) | $T_g$ (° C.) |
|---|---|---|---|
| 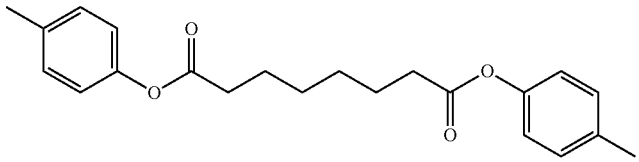 | 80, 83 | 63 | n/a |
| 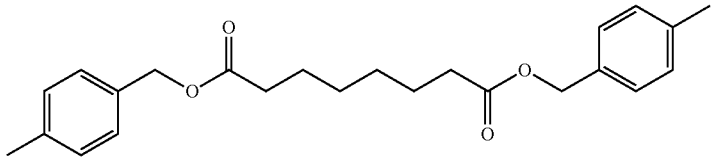 | 71 | 21 | n/a |
| 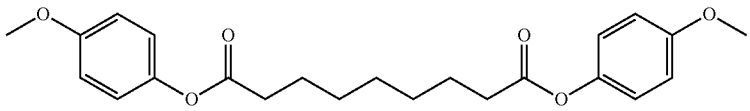 | 87 | ~50 | n/a |
| 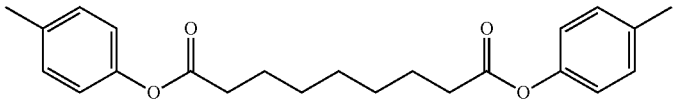 | 69 | 42 | n/a |
| 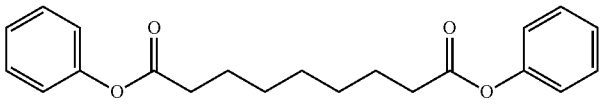 | 58 | 3 | n/a |
| 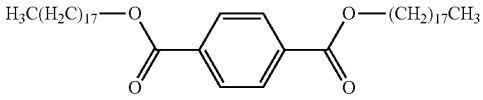 "DST" | 88 | 79 | n/a |
| 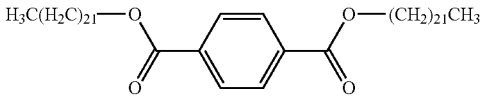 "DBT" | 95 | 82 | n/a |
| 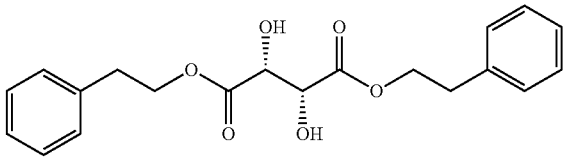 "DPT" | 110 | 83 | n/a |

In embodiments, the crystalline compound is a di-ester compounds made from Scheme 1 below.

Scheme 1

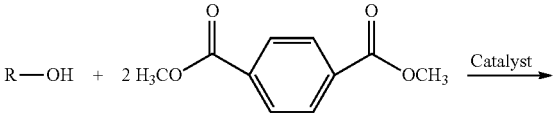

-continued

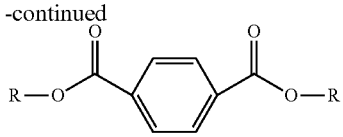

wherein R is a saturated or ethylenically unsaturated aliphatic group in one embodiment with at least about 6 carbon atoms, and in another embodiment with at least about 8 carbon atoms, and in one embodiment with no more than about 100 carbon atoms, in another embodiment with no more than about 80 carbon atoms, and in yet another embodiment with no more than about 60 carbon atoms, although the number of carbon atoms can be outside of these ranges, In a specific embodiment, the crystalline compound is derived from natural fatty alcohols such as octanol, stearyl alcohol, lauryl alcohol, behenyl alcohol, myristyl alcohol, capric alcohol, linoleyl alcohol, and the like. The above reaction may be conducted by combining dimethyl terepthalate and alcohol in the melt in the presence of a tin catalyst, such as, dibutyl tin dilaurate (Fascat 4202), dibutyl tin oxide (Fascat 4100); a zinc catalyst, such as Bi cat Z; or a bismuth catalyst, such as Bi cat 8124; Bi cat 8108, a titanium catalyst such as titanium dioxide. Only trace quantities of catalyst are required for the process.

In embodiments, the catalyst is present in an amount of about 0.01 weight percent to 2 weight percent or of about 0.05 weight percent to about 1 weight percent of the total product.

The reaction can be carried out at an elevated temperature of about 150° C. to about 250° C. or from about 160° C. to about 210° C. The solvent-free process is environmentally sustainable and eliminates problems with byproducts and also means higher reactor throughput.

In embodiments, the crystalline component may have a structure of Formula A:

A

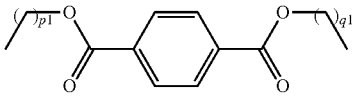

wherein p1 is from about 1 to about 40, and q1 is from about 1 to about 40. In certain embodiments, p1 is from about 8 to about 26, from about 14 to about 20, or from about 16 to about 18. In certain embodiments, q1 is from about 8 to about 26, from about 14 to about 20, or from about 16 to about 18. In certain embodiments, p1 is the same as q1.

In embodiments, the crystalline component is present in an amount of from about 50 percent to about 95 percent by weight, from about 60 percent to about 95 percent by weight, or from about 65 percent to about 95 percent by weight, or from about 70 percent to about 90 percent by weight of the total weight of the CPF toner composition.

Typically, the weight ratio of the crystalline component to the amorphous component is from about 50:50 to about 95:5, or is from about 60:40 to about 95:5, or is from about 70:30 to about 90:10.

In embodiments, the crystalline component is a polyester resin. Crystalline polyester resins can be prepared from a diacid and a diol. Examples of organic diols selected for the preparation of crystalline polyester resins include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfo-p-hydroxybenzoic acid, N,N-bis(2-hydroxyethyl)-2-amino ethane sulfonate, or mixtures thereof. The organic diacid may be selected in an amount of, for example, from about 40 to about 50 mole percent of the resin, and the alkali sulfoaliphatic diacid can be selected in an amount of from about 1 to about 10 mole percent of the resin.

As an example, crystalline resins 1,12-dodecanedioic acid has been prepared with diols from C3 (1,3-propylene glycol), to C12, (1,12-dodecanediol), to yield crystalline polyesters with a Tm from about 60° C. to about 90° C. The properties of crystalline polyesters used in connection with embodiments herein are shown in Table 2 below.

TABLE 2

| | | AV | Tm (° C.) | GPC g/m × 1000 | |
|---|---|---|---|---|---|
| Resin ID | Acid:Diol | Mg KOH/g | 1st | Mw | Mn |
| A | C12:C9 | 10.3 | 71.0 | 24.2 | 6.8 |
| B | C12:C6 | 14.5 | 72.3 | 14.3 | 6.1 |
| C | C12:C3 | 17 | 66.1 | 13.4 | 6.6 |

Toners for cold pressure fix comprised of a mixture of a crystalline polyester resin with a melting point of about 30° C. to about 90° C., and at least one amorphous mono-, di-, tri- and tetra-ester, including rosin esters, based on glycercol, propylene glycol, dipropylene glycol, tartaric acid, citric acid or pentaerythritol, or a terpene oligomer, with from about 16 to about 80 carbons, and with a Tg of from about 0° C. to about 40° C.

In embodiments, the crystalline polyester may have an acid value of about 6 to about 30, an Mn of about 1,000 to about 10,000, and an Mw of about 2,000 to about 30,000.

Toners could be prepared by any means, including conventional extrusion and grinding, suspension, SPSS, incorporated in an N-Cap toner, incorporated in an EA toner, optionally with a shell.

Latexes can be prepared, by, but are not limited to, solvent flash or phase inversion emulsification, including by solvent free methods.

In embodiments, the cold pressure fix toner composition comprises at least one rosinated or rosin ester which may be a mono-, di-, tri-tetra-ester based on an alcohol such as methanol, glycercol (1,2,3-trihydroxypropane), diethylene glycol, ethylene glycol, propylene glycol, dipropylene glycol, menthol, neopentylglycol, pentaerythritol (2,2-bis(hydroxymethyl)1,3-propanediol), phenol, tertiary butyl phenol, and an acid such as tartaric acid, citric acid, oxalic acid, succinic acid, glutaric acid, adipic acid, suberic acid, azelaic acid, fumaric acid, maleic acid, dodecanedioic acid, and sebacic acid. Suitable rosinated esters, without limitation, include those with about 16 to about 80 carbon atoms, including those with an number average molecular weight Mn of about 300 to about 1200, and a weight average molecular weight Mw of about 300 to about 2000. Suitable rosinated esters, without limitation, have an acid number of about 0 to about 300. Optionally monoesters, including monoesters with some acid functionality can be incorporated, including rosin acids, with an acid value of about 30 to about 400.

As used herein, a "rosinated ester" or "rosin ester" synonymously refers to rosin acids that have been esterified. Such rosin acids may include naturally occurring resinous acids exuded by various species of trees, primarily pine and other conifers. The rosin may be separated from the essential oil spirit of turpentine by distillation. Tall oil rosin is produced during the distillation of crude tall oil, a by-product of the kraft paper making process. Additionally, the "stump waste" from pine trees can be distilled or extracted with solvent to separate out rosin, which is called wood rosin. The rosin utilized in the rosin ester may be partially or totally hydrogenated to remove some or essentially all the double bonds in the rosin, which results in a lighter color and significantly improved stability or the rosin and rosin ester. As an example abietic acid can be partially dehyrogenated to form dihydroabietic acid, or full dehydrogenated to form tetrahydroabietic acid.

Again, it may be desirable to incorporate some acid groups in the cold fix toner materials in the amorphous component to provide a negative charge for toner performance and emulsion/aggregation toner processing. For such purposes some amount of the amorphous material that had a free acid end, rather than terminated by an ester, can be used. Alternatively, some of the ester groups might be replaced by ester groups that further include acid functionality. Suitable rosin esters that are available commercially include ABALYN® a rosin methyl ester, PENTALYN® A a rosin pentaerythritol ester, PEXALYN® 9085 a rosin glycerol ester, PEXALYN® T a rosin pentaerythritol ester, PINOVA® Ester Gum 8BG a rosin glycerol ester, FORAL® 85 a hyrogentated rosin glycerol ester, FORAL® 105 a pentaerythritol ester of hydroabietic (rosin) acid, FORAL® 3085 a hydrogenated rosin glycerol ester, HERCOLYN® D a hydrogenated rosin methyl ester, PENTALYN® H a rosin pentaerythritol ester, all available commercially from Pinova; ARAKAWA® Ester Gum G, ARAKAWA® Ester Gum AA-L, ARAKAWA® Ester Gum AAV ARAKAWA® Ester Gum AT rosin esters commercially available from Arakawa Chemical Industries, Ltd.; ARAKAWA® Ester Gum HP, ARAKAWA® Ester Gum H, ARAKAWA® Ester Gum HT hydrogenated rosin esters commercially available from Arakawa Chemical Industries, Ltd.; ARAKAWA® S-80, ARAKAWA® S-100, ARAKAWA® S-115, ARAKAWA® A-75, ARAKAWA® A-100, ARAKAWA® A-115, ARAKAWA® A-125, ARAKAWA® L, ARAKAWA-18 stabilized rosin esters commercially available from Arakawa Chemical Industries, Ltd.; ARAKAWA® KE-311 and KE-100 resins, triglycerides of hydrogenated abietic (rosin) acid commercially available from Arakawa Chemical Industries, Ltd.; ARAKAWA® KE-359 a hydrogenated rosin ester and ARAKAWA® D-6011 a disproportionated rosin ester commercially available from Arakawa Chemical Industries, Ltd.; and SYLVALITE® RE 10L, SYLVALITE® RE 80HP, SYLVALITE® RE 85L, SYLVALITE® RE 100XL, SYLVALITE® RE 100L, SYLVALITE® RE 105L, SYLVALITE® RE 110L. SYLVATAC® RE 25, SYLVATAC® RE 40, SYLVATAC® RE 85, SYLVATAC® RE 98 all available from Arizona Chemical; and PERMALYN™ 5095 a rosin glycerol ester, PERMALYN™ 5095-C a rosin glycerol ester, PERMALYN™ 5110 a rosin pentaerythritol ester, PERMALYN™ 5110-C, a rosin pentaerythritol ester, PERMALYN™ 6110 a rosin pentaerythritol ester, PERMALYN™ 6110-M a rosin pentaerythritol ester, PERMALYN™ 8120 a rosin pentaerythritol ester, STAYBELITE™ Ester 3-E a partially hydrogenated rosin ester, STAYBELITE™ Ester 5-E a partially hydrogenated rosin ester, and STAYBELITE™ Ester 10-E a partially hydrogenated rosin ester all available from Eastman Kodak; and ARAKAWA® ESTER E-720 and SUPER ESTER E-730-55 rosin ester latexes commercially available from Arakawa Chemical Industries, Ltd. Table 3 below shows examples of other amorphous esters suitable for cold pressure fix toners disclosed herein.

TABLE 3

| Structure | $T_{melt}$ (° C.) | $T_{crys}$ (° C.) | $T_g$ (° C.) |
|---|---|---|---|
| 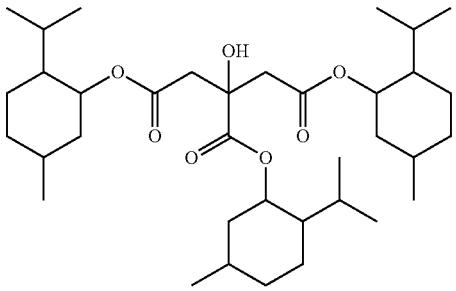 "TMC" | n/a | n/a | 6 |

TABLE 3-continued

| Structure | $T_{melt}$ (° C.) | $T_{crys}$ (° C.) | $T_g$ (° C.) |
|---|---|---|---|
| 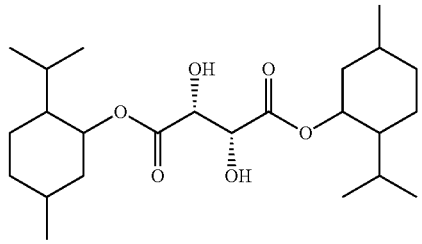 "DMT" | n/a | n/a | 11-16 |
| 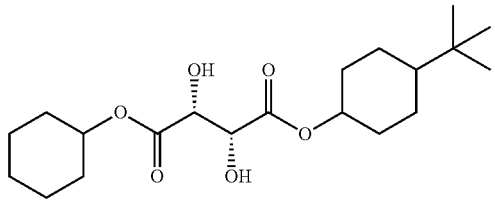 + mixtures "TBCT" | n/a | n/a | 5 |

Other suitable small molecule amorphous materials include other modified rosins, and are not limited to rosin esters. Examples of other suitable small molecule amorphous modified rosins include UNI-TAC® 70 available commercially from Arizona Chemicals, and ABITOL™ E a Hydroabietyl alcohol available commercially from Eastman Kodak; and POLY-PALE™ a dimerized rosin available commercially from Eastman Kodak.

Other suitable small molecule amorphous materials include terpene resins, such as resins from α-pinene, including PICCOLYTE® A25, PICCOLYTE® A115, and PICCOLYTE® A125 from Pinova; and resins from β-pinene, PICCOLYTE®S25, PICCOLYTE® S85, PICCOLYTE® S115, and PICCOLYTE® S125 from Pinova; and resins from d-limonene, including PICCOLYTE® C85, PICCOLYTE® C105, PICCOLYTE® C115, PICCOLYTE® C115, PICCOLYTE® D115 from Pinova; and resins from mixed terpenes, such as PICCOLYTE® F105 IG and PICCOLYTE® F115 IG from Pinova; and other terpene based resins including SYLVARES® TR A25, SYLVARES® TR B115, SYLVARES® TR 7115, SYLVARES® TR 7125, SYLVAGUM® TR 90, SYLVAGUM® TR 105, ZONATAC® NG 98 a styrene modified terpene resin from Arizona Chemicals; and synthetic polyterpene resins such as NEVTAC® 2300, NEVTAC® 100, and NEVTAC® 80 commercially available from Neville Chemical Company; and PICCOLYTE® HM106 Ultra a styrenated polyterpene resin of d-limonene from Pinova; and hydrogenated terpene resins such as CLEARON® P115, CLEARON® P105, CLEARON® P85 from Yasuhara Chemical Co., Ltd.; Hydrogenated Aromatic Modified Terpene Resin such as CLEARON®M115, CLEARON® M105, CLEARON® K100, CLEARON® K4100, Aromatic Modified Terpene Polymer YS Resin TO115, YS Resin TO105, YS Resin TO85, YS Resin TR105 from Yasuhara Chemical Co., Ltd.; and Terpene phenolic resins, including YS Polyster U130, YS Polyster U115, YS Polyster T115, YS Polyster T100, YS Polyster T80 all from Yasuhara Chemical Co., Ltd., and SYLVARES® TP 96, SYLVARES® TP 300, SYLVARES® TP 2040, SYLVARES® TP 2019, SYLVARES® TP 2040HM, SYLVARES® TP 105, SYLVARES® TP 115 from Arizona chemicals.

Other suitable small molecule amorphous materials include rosin acids, including but not limited to FORAL® AX a thermoplastic, acidic resin produced by hydrogenating wood rosin and FORAL® NC synthetic resin is the partial sodium resinate of the highly hydrogenated wood rosin, FORAL® AX, both available commercially from Pinova; and ARAKAWA® KE-604, ARAKAWA® KE-604B, ARAKAWA® KR-610, ARAKAWA® KR-612, and ARAKAWA® KR-614 hydrogenated rosins available commercially from Arakawa Chemical Industries, Ltd.

Other suitable small molecule amorphous materials include the class of materials known as tackifiers, in which category many of the amorphous materials herein are typically included. Other tackifiers are also known, and may be suitable as the small molecule amorphous material used herein, or may be added in effective amounts of up to about 40%. Examples of other potentially effective tackifiers include aliphatic C5 monomer resin, PICCOTAC™ 1095, hydrogenated C5 monomer resin EASTOTAC™ H-100R, EASTOTAC™ H-100L Resin, EASTOTAC™ H-100W Resin, C9 monomer resins KRISTALEX™ 1120, PICCOTEX™ 75, PICCOTEX™ LC, PICCOTEX™ 100 Hydrocarbon Resin, styrenic C8 monomers resins PICCOLASTIC™ A5, PICCOLASTIC™ A75, hydrogenated, C9 aromatic monomer resins REGALITE™ S1100, partially hydrogenated, C9 aromatic monomer resins REGALITE™ S5100, REGALITE™ S7125, REGALITE™ R1100, REGALITE™ R7100, REGALITE™ R1090, REGALITE™ R1125, REGALITE™ R9100, mixed C5 aliphatic and C9 aromatic monomer resins PICCOTAC™ 8095, PICCOTAC™ 9095, PICCOTAC™ 7050, aromatic hydrocarbon resins, REGALREZ™ 1094, hydrogenated C9 monomer aromatic hydrocarbon resins, REGALREZ™ 1085, partially hydrogenated, C9 aromatic monomer resin REGALREZ™ all from Eastman; Aliphatic C5 modified petroleum resin WINGTACK® 10, WINGTACK® 95, WINGTACK® 98, WINGTACK® 86, aromatically modified petroleum resin WINGTACK® ET and aromatically modified petroleum resin WINGTACK® STS all from Cray Valley.

In the cold pressure fix toner composition, an acid functionality may be present on the at least one crystalline ester, the at least one amorphous rosinated ester, or both. In some such embodiments, the acid functionality is incorporated as a monoester of a diacid. In other embodiments, the acid functionality is incorporated as a separate functional group present on the at least one crystalline ester. In yet other embodiments, the acid functionality is incorporated as a separate functional group present on the at least one amorphous rosinated ester. In embodiments, an amorphous small molecule component may have an acid value of about 0 to about 30.

In embodiments the temperature for the viscosity of the material to be reduced to a value of about 10,000 Pa-s at about 100 kgf/cm$^2$ applied pressure, is from about 0° C. to about 50° C., in other embodiments about 10° C. to about 40° C., in further embodiments from about 0° C. to about 30° C. In other embodiments the applied pressure for toner materials flow is from about 25 to about 400 kgf/cm$^2$, and in further embodiments from about 50 to about 200 kgf/cm$^2$. For cold pressure fixable toner it may be desirable to have the toner material flow near room temperature under the applied pressure of the cold pressure fixing system, to enable the toner to flow over the substrate surface and into pores or fibers in the substrate, as well as to enable the toner particles to flow into each other, thus providing a smooth continuous toner layer that is effectively adhered to the substrate. It may be desirable that the pressure applied be relatively low compared to the prior art, such as about 100 kgf/cm$^2$. However, in embodiments the pressure can be higher, up to about 400 kgf/cm$^2$, or lower, as little as 25 kgf/cm$^2$, provided that the above described conditions for onset of toner flow and flow viscosity can be met. In embodiments, some heat may be applied to preheat the toner or the paper prior to entry to the cold pressure fixing system, which can enable cold pressure fix for temperatures somewhat above room temperature.

In embodiments, it may be desirable for cold pressure fix that under low pressures, such as about 10 kgf/cm$^2$ applied pressure the cold pressure fix toner does not flow significantly such that the toner particles stick together, for example in the toner cartridge, or in the printer, including in the developer housing, or on the imaging surfaces such as the photoreceptor, or in embodiments the intermediate transfer belt. In shipping or in the printer the temperature may rise to as much as 50° C., thus in embodiments it may be desirable that the toner does not flow significantly to allow the particles stick together up to 50° C. at about 10 kgf/cm$^2$. Thus, in embodiments the temperature for the viscosity of the material to be reduced to a value of about 10,000 Pa-s, for the cold pressure fix toner at a lower pressure of about 10 kgf/cm$^2$ applied pressure, is from about 50° C. to about 70° C., in embodiments about 55° C. to about 70° C., in embodiments about 60° C. to about 90° C., or in further embodiments at about 20 kgf/cm$^2$ to about 40 kgf/cm$^2$.

Thus it may be desirable to have a high temperature for material flow at low pressures representative of storage and usage in the printer, and a low temperature for material at the desired higher cold pressure fix pressure. In embodiments there is a temperature shift calculated in the range from about 10° C. to about 60° C. where the flow viscosity of the cold pressure fix composition equal to about 10,000 pascal-seconds, when the applied pressure on the cold pressure fix composition is increased from 10 to 100 Kgf/cm$^2$. In such embodiments, the temperature shift can be calculated as, $$\Delta T_{\eta=0000}=T_{\eta=10000}(10\ \mathrm{Kgf/Cm^2})-T_{\eta=10000}(100\ \mathrm{Kgf/Cm^2})$$

where $T_{\eta=10000}$(10 kgf/cm$^2$) is the temperature for flow viscosity n of 10000 Pa-s at 10 kgf/cm$^2$ applied pressure and $T_{\eta=10000}$(100 kgf/cm$^2$) is the temperature for flow viscosity η of 10000 Pa-s at 100 kgf/cm$^2$. In other embodiments the low pressure for storage and printer usage applied can be in the range of about 10 kgf/cm$^2$ to about 40 kgf/cm$^2$, and the high pressure for applied for cold pressure fix can be in the range of about 25 kgf/cm$^2$ to about 400 kgf/cm$^2$.

In embodiments, there are provided methods of cold pressure fix toner application comprising providing a cold pressure fix toner composition comprising: at least one crystalline material and one small molecule amorphous material $C_{16}$ to $C_{80}$ crystalline ester having a melting point in a range from about 30° C. to about 130° C. and at least one amorphous ester having a $T_g$ of from about −30° C. to about 70° C., disposing the cold pressure fix toner composition on a substrate, and applying pressure to the disposed composition on the substrate under cold pressure fixing conditions. In some embodiments, the applied pressure is in a range from about 25 kgf/cm$^2$ to about 400 kgf/cm$^2$. In embodiments, cold pressure fix is accomplished by applying pressure in the aforementioned range between two fixing rolls that may be selected from known fixing rolls, such as in U.S. Pat. No. 8,541,153 herein incorporated by reference. Examples of the fixing rolls are cylindrical metal rolls, which optionally may be coated with fluorine containing resins such as TEFLON® PTFE polytetrafluoroethylene resins, TEFLON® PFA perfluoroalkoxy resins, TEFLON® FEP a fluorinated ethylene propylene, DUPONT™ TEFLON® AF amorphous fluoroplastic resins, and silicon resins, or a combination of the different resins. The two fixing rolls may be made of the same materials or may be different. In embodiments the fixing step is cold pressure fix without any direct application of heat in the fixing step. However, due to the heat from the printer components, frictional heating between the rolls, the temperature may be elevated above room temperature in the fusing nip. In addition, the paper and or toner layer on the paper in embodiments may be heated for example with a heat lamp prior to the cold pressure fix apparatus.

In embodiments, there are provided latexes formed from a cold pressure fix toner composition comprising at least one $C_{16}$ to $C_{60}$ crystalline ester having a melting point in a range from about 30° C. to about 130° C. and at least one $C_{16}$ to $C_{80}$ amorphous rosinated ester having a $T_g$ of from about 0° C. to about 60° C.

Toners can be prepared from the cold press toner compositions disclosed herein by any means, including conventional extrusion and grinding, suspension, SPSS (Spherical Polyester Toner by Suspension of Polymer/Pigment Solution and Solvent Removal Method, as described in Journal of the Imaging Society of Japan, Vol. 43, 1, 48-53, 2004), incorporated in an N-Cap toner, (encapsulated toner, as described for example in U.S. Pat. No. 5,283,153 and incorporated in an emulsion aggregation toner, optionally with a shell. Where needed for toner applications, latexes can be made incorporating the crystalline and/or amorphous mixtures, prepared by solvent flash, by phase inversion emulsification, including by solvent free methods.

Other additives may be present in the CPF toners disclosed here. The CPF toner compositions of the present embodiments may further optionally include one or more conventional additives to take advantage of the known functionality associated with such conventional additives. Such additives may include, for example, colorants, antioxidants, defoamer, slip and leveling agents, clarifier, viscosity modifier, adhesive, plasticizer and the like. When present, the optional additives may each, or in combination, be present in the CPF toner in any desired or effective amount, such as from about 1% to about 10%, from about 5% to about 10%, or from about 3% to about 5% by weight of the CPF toner.

In a typical CPF toner composition antioxidants are added for preventing discoloration of the small molecule composition. In embodiments, the antioxidant material can include IRGANOX® 1010; and NAUGARD® 76, NAUGARD® 445, NAUGARD® 512, and NAUGARD® 524. In embodiments, the antioxidant is NAUGARD® 445. In other embodiments the antioxidant material can include MAYZO® BNX® 1425 a calcium salt of phosphonic acid, and MAYZO® BNX® 358 a thiophenol both available commercially from MAYZO®, and ETHANOX® 323A a nonylphenol disulfide available commercially from SI Group.

In embodiments, CPF toners disclosed herein may further comprise a plasticizer. Exemplary plasticizers may include Uniplex 250 (commercially available from Unitex), the phthalate ester plasticizers commercially available from Ferro under the trade name SANTICIZER®, such as dioctyl phthalate, diundecyl phthalate, alkylbenzyl phthalate (SANTICIZER® 278), triphenyl phosphate (commercially available from Ferro), KP-140, a tributoxyethyl phosphate (commercially available from Great Lakes Chemical Corporation), MORFLEX® 150, a dicyclohexyl phthalate (commercially available from Morflex Chemical Company Inc.), trioctyl trimellitate (commercially available from Sigma Aldrich Co.), and the like. Plasticizers may be present in an amount from about 0.01 to about 30 percent, from about 0.1 to about 25 percent, from about 1 to about 20 percent by weight of the CPF toner.

In embodiments, the cold pressure fix toner compositions described herein also include a colorant. Any desired or effective colorant can be employed in the cold pressure fix toner compositions, including dyes, pigments, mixtures thereof. Any dye or pigment may be chosen, provided that it is capable of being dispersed or dissolved in the CPF toner and is compatible with the other CPF toner components. Any conventional cold pressure fix toner colorant materials, such as Color Index (C.I.) Solvent Dyes, Disperse Dyes, modified Acid and Direct Dyes, Basic Dyes, Sulphur Dyes, Vat Dyes, fluorescent dyes and the like. Examples of suitable dyes include NEOZAPON® Red 492 (BASF); ORASOL® Red G (Pylam Products); Direct Brilliant Pink B (Oriental Giant Dyes); Direct Red 3BL (Classic Dyestuffs); SUPRANOL® Brilliant Red 3BW (Bayer AG); Lemon Yellow 6G (United Chemie); Light Fast Yellow 3G (Shaanxi); Aizen Spilon Yellow C-GNH (Hodogaya Chemical); Bemachrome Yellow GD Sub (Classic Dyestuffs); CARTASOL® Brilliant Yellow 4GF (Clariant); Cibanone Yellow 2G (Classic Dyestuffs); ORASOL® Black RLI (BASF); ORASOL® Black CN (Pylam Products); Savinyl Black RLSN (Clariant); Pyrazol Black BG (Clariant); MORFAST® Black 101 (Rohm & Haas); Diaazol Black RN (ICI); THERMOPLAST® Blue 670 (BASF); ORASOL® Blue GN (Pylam Products); Savinyl Blue GLS (Clariant); LUXOL® Fast Blue MBSN (Pylam Products); Sevron Blue 5GMF (Classic Dyestuffs); BASACID® Blue 750 (BASF); KEYPLAST® Blue (Keystone Aniline Corporation); NEOZAPON® Black X51 (BASF); Classic Solvent Black 7 (Classic Dyestuffs); SUDAN® Blue 670 (C.I. 61554) (BASF); SUDAN® Yellow 146 (C.I. 12700) (BASF); SUDAN® Red 462 (C.I. 26050) (BASF); C.I. Disperse Yellow 238; Neptune Red Base NB543 (BASF, C.I. Solvent Red 49); Neopen Blue FF-4012 (BASF); Fatsol Black BR (C.I. Solvent Black 35) (Chemische Fabriek Triade BV); Morton Morplas Magenta 36 (C.I. Solvent Red 172); metal phthalocyanine colorants such as those disclosed in U.S. Pat. No. 6,221,137, the disclosure of which is totally incorporated herein by reference, and the like. Polymeric dyes can also be used, such as those disclosed in, for example, U.S. Pat. Nos. 5,621,022 and 5,231,135, the disclosures of each of which are herein entirely incorporated herein by reference, and commercially available from, for example, Milliken & Company as Milliken Ink Yellow 869, Milliken Ink Blue 92, Milliken Ink Red 357, Milliken Ink Yellow 1800, Milliken Ink Black 8915-67, uncut Reactint Orange X-38, uncut Reactint Blue X-17, Solvent Yellow 162, Acid Red 52, Solvent Blue 44, and uncut Reactint Violet X-80.

Pigments are also suitable colorants for the cold pressure fix toners. Examples of suitable pigments include PALIOGEN® Violet 5100 (BASF); PALIOGEN® Violet 5890 (BASF); HELIOGEN® Green L8730 (BASF); LITHOL® Scarlet D3700 (BASE); SUNFAST® Blue 15:4 (Sun Chemical); HOSTAPERM® Blue B2G-D (Clariant); HOSTAPERM® Blue B4G (Clariant); Permanent Red P-F7RK; HOSTAPERM® Violet BL (Clariant); LITHOL® Scarlet 4440 (BASF); Bon Red C (Dominion Color Company); ORACET® Pink RF (BASF); PALIOGEN® Red 3871 K (BASF); SUNFAST® Blue 15:3 (Sun Chemical); PALIOGEN® Red 3340 (BASF); SUNFAST® Carbazole Violet 23 (Sun Chemical); LITHOL® Fast Scarlet L4300 (BASF); SUNBRITE® Yellow 17 (Sun Chemical); HELIOGEN® Blue L6900, L7020 (BASF); SUNBRITE® Yellow 74 (Sun Chemical); SPECTRA PAC C Orange 16 (Sun Chemical); HELIOGEN® Blue K6902, K6910 (BASF); SUNFAST® Magenta 122 (Sun Chemical); HELIOGEN® Blue D6840, D7080 (BASF); SUDAN® Blue OS (BASF); NEOPEN Blue FF4012 (BASF); PV Fast Blue B2GO1 (Clariant); IRGALITE Blue GLO (BASF); PALIOGEN® Blue 6470 (BASF); SUDAN® Orange G (Aldrich); SUDAN® Orange 220 (BASF); PALIOGEN® Orange 3040 (BASF); PALIOGEN® Yellow 152, 1560 (BASF); LITHOL® Fast Yellow 0991 K (BASF); PALIOTOL Yellow 1840 (BASF); NOVOPERM Yellow FGL (Clariant); Ink Jet Yellow 4G VP2532 (Clariant); Toner Yellow HG (Clariant); Lumogen Yellow D0790 (BASF); Suco-Yellow L1250 (BASF); Suco-Yellow D1355 (BASF); Suco Fast Yellow D1355, D1351 (BASF); HOSTAPERM Pink E 02 (Clariant); Hansa Brilliant Yellow 5GX03 (Clariant); Permanent Yellow GRL 02 (Clariant); Permanent Rubine L6B 05 (Clariant); FANAL Pink D4830 (BASF); CINQUASIA® Magenta (DU PONT); PALIOGEN® Black L0084 (BASF); Pigment Black K801 (BASF); and carbon blacks such as REGAL 330™ (Cabot), Nipex 150 (Evonik) Carbon Black 5250 and Carbon Black 5750 (Columbia Chemical), and the like, as well as mixtures thereof.

Pigment dispersions in the CPF toner may be stabilized by synergists and dispersants. Generally, suitable pigments may be organic materials or inorganic. Magnetic material-based pigments are also suitable, for example, for the fabrication of robust Magnetic Ink Character Recognition (MICR) inks. Magnetic pigments include magnetic nanoparticles, such as for example, ferromagnetic nanoparticles.

Also suitable are the colorants disclosed in U.S. Pat. Nos. 6,472,523, 6,726,755, 6,476,219, 6,576,747, 6,713,614, 6,663,703, 6,755,902, 6,590,082, 6,696,552, 6,576,748, 6,646,111, 6,673,139, 6,958,406, 6,821,327, 7,053,227, 7,381,831 and 7,427,323, the disclosures of each of which are incorporated herein by reference in their entirety.

In embodiments, solvent dyes are employed. An example of a solvent dye suitable for use herein may include spirit soluble dyes because of their compatibility with the CPF toner carriers disclosed herein. Examples of suitable spirit solvent dyes include NEOZAPON® Red 492 (BASF); ORASOL® Red G (Pylam Products); Direct Brilliant Pink B (Global Colors); Aizen Spilon Red C-BH (Hodogaya Chemical); Kayanol Red 3BL (Nippon Kayaku); Spirit Fast Yellow 3G; Aizen Spilon Yellow C-GNH (Hodogaya Chemical); CARTASOL® Brilliant Yellow 4GF (Clariant); PERGASOL® Yellow 5RA EX (Classic Dyestuffs); ORASOL® Black RLI (BASF); ORASOL® Blue GN (Pylam Products); Savinyl Black RLS (Clariant); MORFAST® Black 101 (Rohm and Haas); THERMOPLAST® Blue 670 (BASF); Savinyl Blue GLS (Sandoz); LUXOL® Fast Blue MBSN (Pylam); Sevron Blue 5GMF (Classic Dyestuffs); BASACID® Blue 750 (BASF); KEYPLAST® Blue (Keystone Aniline Corporation); NEOZAPON® Black X51 (C.I. Solvent Black, C.I. 12195) (BASF); SUDAN® Blue 670 (C.I. 61554) (BASF); SUDAN® Yellow 146 (C.I. 12700) (BASF); SUDAN® Red 462 (C.I. 260501) (BASF), mixtures thereof and the like.

The colorant may be present in the cold pressure fix toner in any desired or effective amount to obtain the desired color or hue such as, for example, at least from about 0.1 percent by weight of the CPF toner to about 50 percent by weight of the CPF toner, at least from about 0.2 percent by weight of the CPF toner to about 20 percent by weight of the CPF toner, and at least from about 0.5 percent by weight of the CPF toner to about 10 percent by weight of the CPF toner. The colorant may be included in the CPF toner in an amount of from, for example, about 0.1 to about 15% by weight of the CPF toner, or from about 0.5 to about 6% by weight of the CPF toner.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1-C16 to C80 Crystalline Organic Material

This example describes testing of exemplary cold pressure fix toners in accordance with embodiments herein.

Shimadzu flow tester evaluation of cold pressure fix capability: In order to test the ability of materials to flow under pressure, as required by cold pressure fix, a Shimadzu Flow tester also known as a Capillary Rheometer (available from Shimadzu Scientific Instruments) was used. Solid samples were either scalloped away or cracked into pieces with a rubber mallet. Samples were neither dried nor ground. All materials were pressed into a slug with 5000 pounds of pressure and a 10 second hold. The samples were run on a Shimadzu CFT 500/100 tester. All samples were extruded through a 1.0×1.0 mm cone die using a piston with a cross sectional area of 1 $cm^2$. Typical sample weights were between about 1.5 g and 2.5 grams. The process conditions were: about 23 to 26° C. to begin, 10 Kg or 100 Kg, 180 second pre-heat and a ramp rate of 3° C./minute. Thus, the two pressures tested were 10 $kgf/cm^2$ as a control at low pressure, and 100 $Kgf/cm^2$ as a high pressure, the latter high pressure representative of the target pressure for cold pressure fix. Table 4 below shows the compositions and Shimadzu results for two control toners.

TABLE 4

| | | Transition Temperature (° C., $10^4$ Pa-s) | | ΔT (° C.) |
|---|---|---|---|---|
| Sample | Polymer formulation | 100 $kgf/cm^2$ | 10 $kgf/cm^2$ | 10-100 $kgf/cm^2$ |
| Control 1 | 50:50 copolymer of styrene And 1-t-butyl-2-ethenyl benzene | 113 | 123 | 10 |
| Control 2 | 46:46:8 ratio of amorphous resin A:amorphous resin B:crystalline resin C | 100 | 100 | 0 |

Control 1 is an example of a cold pressure fix toner which is comprised of a copolymer of styrene withl-tertiary-butyl-2-ethenyl benzene and a polyolefin wax, the Xerox 4060 cold pressure fix toner. Table 4 shows that the Control 1 toner cold pressure fix toner flow, the transition from high to low viscosity at about $10^4$ Pa-s, occurs about 10° C. lower at high pressure than at low pressure, and even at high pressure has a flow transition temperature of over 100° C. Note Control 1 is designed to fix at about 300 $kgf/cm^2$, about 3× higher than applied here. But clearly is not suitable for cold pressure fix at 100 $kgf/cm^2$.

Control 2 is a black emulsion/aggregation toner of particle size of about 5.7 μm comprised of a core of about 25% each of polyester A and polyester B, about 8% of crystalline polyester C, about 10% polyethylene wax, about 6% carbon black and 1% cyan pigment, and a shell of about 14% each of polyester A and polyester B, where polyester A has an average molecular weight (Mw) of about 86,000, a number average molecular weight (Mn) of about 5,600, and an onset glass transition temperature (Tg onset) of about 56° C., where polyester B has a Mw of about 19,400, an Mn of about 5,000, a Tg onset of about 60° C., and where the crystalline polyester resin C has an Mw of about 23,300, an Mn of about 10,500, and a melting temperature (Tm) of about 71° C., wherein the polyethylene wax has a Tm of about 90° C. Both amorphous resins were of the formula

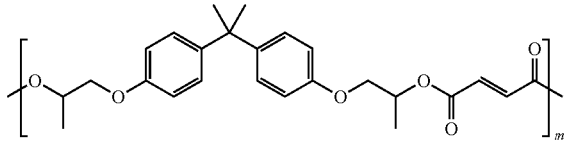

wherein m is from about 5 to about 1000. The crystalline resin was of the formula

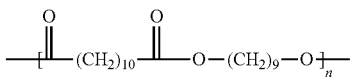

wherein n is from about 5 to about 2000.

As shown in Table 4 Control 2 toner, which is a mixture of crystalline and amorphous polymer resins, has no difference in rheology with pressure at all, and also has a very high transition temperature of 100° C. to low viscosity, thus is not itself a candidate for cold pressure fix at this pressure.

Table 5 shows the compositions and results for samples with small molecule amorphous and crystalline materials.

TABLE 5

| | Crystalline small molecule | | Amorphous small molecule | | Amorphous properties | | | | | Transition Temperature (° C., $10^4$ Pa-s) | | ΔT (° C.) |
|---|---|---|---|---|---|---|---|---|---|---|---|---|
| Sample | Structure | wt % | Structure | wt % | Tg (° C.) | Ts (° C.) | Mn | Mw | AV | 100 kgf/cm$^2$ | 10 kgf/cm$^2$ | 10 – 100 kgf/cm$^2$ |
| 1 | Distearyl terephthalate | 100 | none | | NA | NA | NA | NA | NA | 78 | 83 | 5 |
| 2 | Ester (II) | 70 | Benzoate ester mixture (III) | 30 | NA | NA | NA | NA | NA | 54 | 69 | 15 |
| 3 | Distearyl terephthalate | 79 | SYLVATAC ® RE40 rosin ester | 21 | 5 | 35 | 850 | 1275 | 14 | 45 | 75 | 30 |
| 4 | Distearyl terephthalate | 79 | SYLVARES ™ TR A25 polyterpene | 21 | −20 | 25 | 330 | 462 | 0 | 38 | 77 | 39 |
| 5 | Distearyl terephthalate | 79 | SYLVALITE ® RE 85L rosin ester | 21 | 39 | 85 | 810 | 1053 | 10 | 60 | 80 | 20 |
| 6 | Distearyl terephthalate | 79 | SYLVARES ™ TP 96 polyterpene phenolic | 21 | 47 | 95 | 520 | 676 | 0 | 63 | 78 | 15 |
| 7 | Distearyl terephthalate | 79 | Uni-Tac 70 modified rosin | 21 | 45 | 80 | 315 | 756 | 140 | 61 | 78 | 17 |
| 8 | Distearyl terephthalate | 79 | Arakawa Ester Gum H hydrogenated rosin ester | 21 | 34 | 68 | no data | no data | 10 | 55 | 79 | 24 |
| 9 | Distearyl | 70 | SYLVARES ™ | 30 | −20 | 25 | 330 | 462 | 0 | 30 | 65 | 35 |
| 10 | terephthalate | 60 | TR A25 polyterpene | 40 | −20 | 25 | 330 | 462 | 0 | 27 | 59 | 32 |
| 11 | Distearyl | 79 | SYLVALITE□ | 21 | −20 | liquid | 680 | 748 | 10 | 35 | 81 | 46 |
| 12 | terephthalate | 70 | RE 10L rosin | 30 | −20 | liquid | 680 | 748 | 10 | 26 | 73 | 47 |
| 13 | | 60 | ester | 40 | −20 | liquid | 680 | 748 | 10 | 26 | 77 | 51 |

Sample 1 is comprised of distearyl terephthalate, or DST, the diester (I):

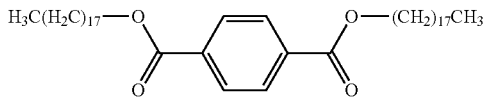

(I)

Sample 2 is comprised primarily of a 70:30 weight ratio of a crystalline diester (II) with an amorphous short chain oligomer mixture comprised of an amide and an ester in the main chain, terminated as benzoate esters (Ill).

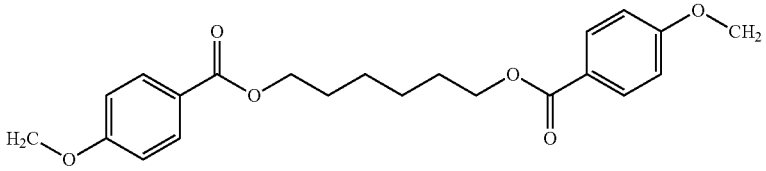

(II)

-continued
(III)
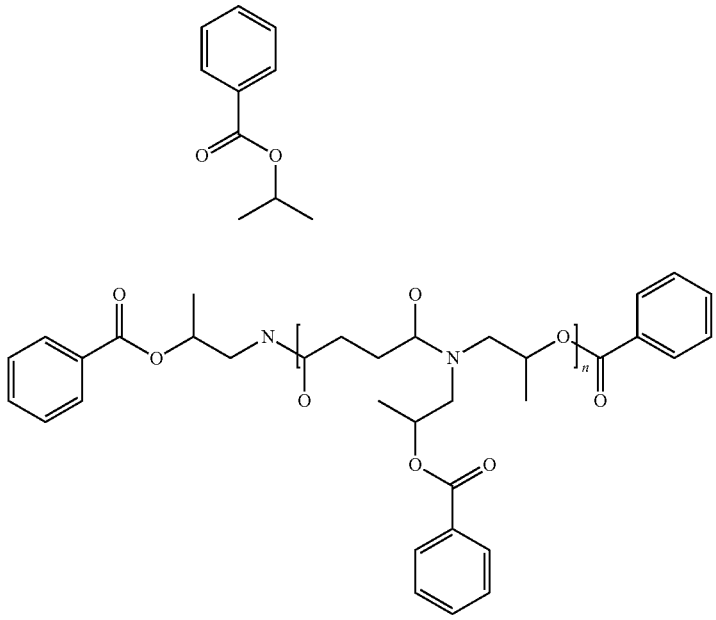
n = 0, 1, 2
Sample 3 has a 79:21 ratio of the crystalline distearyl terephthalate (DST; compound (I)) and SYLVATAC® RE40 an amorphous mixture of rosinated esters (IV), the main component a diester of diethylene glycol, and minor components of a monoester of diethylene glycol, and di-, tri- and tetra-esters of pentaerythritol.
(IV)
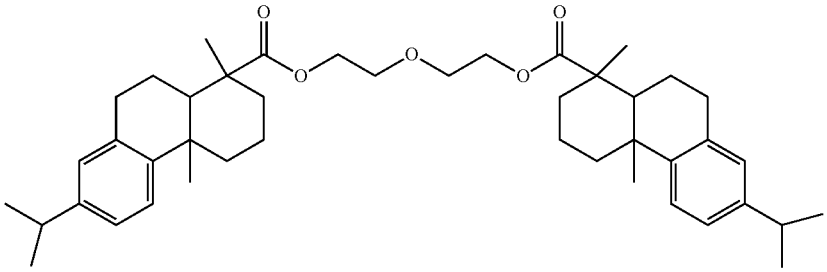
81%
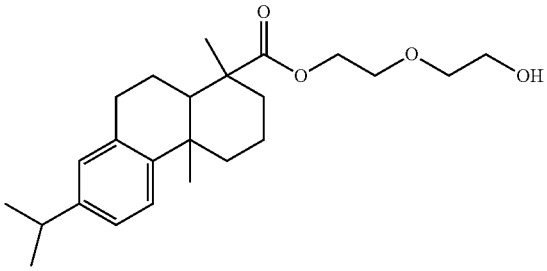
2%

-continued

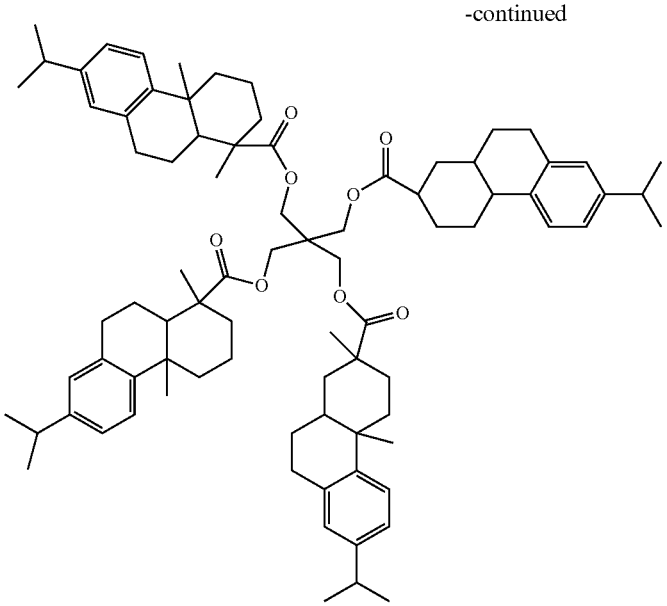

7%

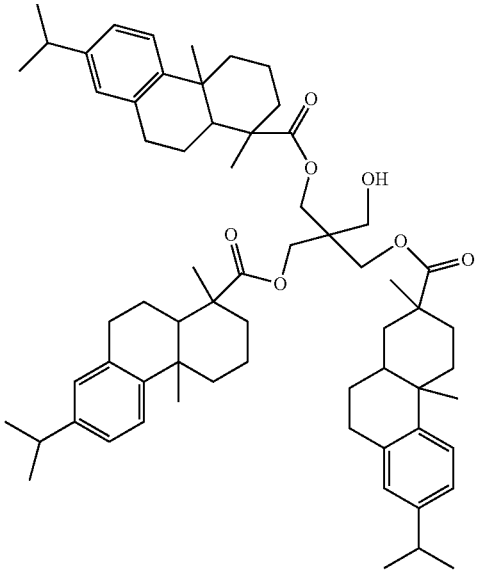

2.2%

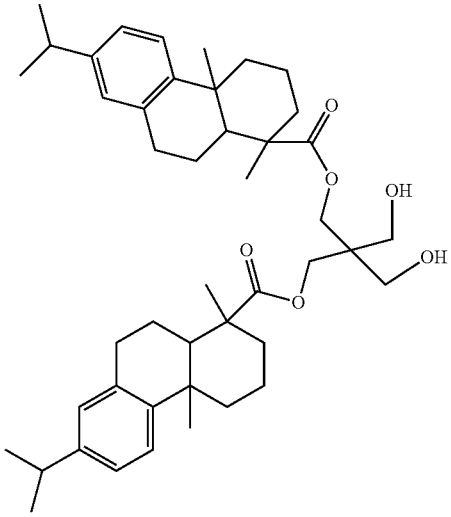

4.7%

The Standard cold press fix toner (Control 1 in Table 4) has a transition temperature for $10^4$ Pa-s at about 113° C. which is too high in temperature to be useful for cold pressure fix, and a shift of 10° C. with high pressure. The resin-based toner (Control 2) with crystalline and amorphous polyester resins has no temperature shift with pressure and thus is not suitable as major components for cold pressure fix. The designs using crystalline/amorphous mixtures of small molecule esters, such as Sample 2 solid ink and in particular Sample 3 solid ink (Table 5) are suitable cold press fix materials. Sample 3, in particular, has a larger shift with pressure as the Standard cold press fix toner (Control 1), but with a much lower transition temperature that is approaching room temperature. Thus, Samples 1 and 3 represent an advantage over currently employed cold press fix toners.

Example 2-Crystalline Polyester

Flow tester evaluation of cold pressure fix capability: To test the ability of the materials to flow under pressure for cold pressure fix (CPF), a Shimadzu flow tester was used. Solid samples were either scalloped away or cracked into pieces with a rubber mallet. All materials were pressed into a slug with 5,000 pounds of pressure and a 10 second hold. The samples were run on a Shimadzu CFT 500/100 tester. All samples were extruded through a 1.0×1.0 mm cone die using a piston with a cross sectional area of 1 $cm^2$. The process conditions were: 27.7° C. to begin, either 10 Kg or 100 Kg, 180 second pre-heat and a ramp rate of 3° C./minute. Thus, the two pressures tested were 10 $kgf/cm^2$ and 100 $kgf/cm^2$. The latter is a particularly useful target pressure for CPF. Results are tabulated in Table 6.

Useful designs generally have a transition temperature to reach a viscosity of $10^4$ Pa-s, of about 0° C. to 50° C. at 100 kgf/cm$^2$ to enable room temperature fusing, and a of about 55° C. to 70° C. at low pressure, for good toner blocking. Example 1 uses a crystalline small molecule, distearyl terephthalate, and an amorphous small molecule, SYLVARES™ TR A25, a small molecule oligomeric alpha-pinene. The high pressure onset temperature of this material in Example 1 was about 38° C., just above room temperature, while the transition at low pressure is still high enough at about 73° C. to potentially provide reasonable blocking.

By contrast, in the present Example which is a mixture of crystalline C12:C9 diacid:diol (CPE) resin and amorphous resins, instead of crystalline and amorphous small molecules, there was no perceived shift with pressure, and thus there is a very high transition temperature at high pressure. The CPE polyester resin alone also does not show any shift with pressure and thus has a very high transition temperature at high pressure. Also note that the CPE low pressure transition temperature is about 73° C., close to the CPE melt point, but when an amorphous resin with $T_g$ of about 55° C. to 60° C. is added, the transition temperature actually increases. Thus, unexpectedly a CPF toner based on a mixture of these amorphous and crystalline polyester resins is not suitable for CPF.

It was therefore very surprising that the same C12:C9 CPE resin mixed with the SYLVARES™ TR A25 (a small molecule oligomeric alpha pinene resin) shifted the transition temperature to lower temperature of about 54° C. at high pressure, a temperature shift of 15° C. The CPE with diol chain lengths of C3 and C6 also has a similar high pressure transition of about 54° C. The low pressure transition was in all cases very close to the melt point of the CPE. So in all cases at low pressure these would all pass blocking criterion, while providing a much lower transition at high pressure than the control material.

TABLE 6

| | | Crystalline Material Properties | | | Phase Change Transition Temperature, $T_{pc}$ (° C.) @1 × $10^4$ Pa-s | | |
|---|---|---|---|---|---|---|---|
| Sample | Comment | Melt point (° C.) | Mw | Mn | $T_{pc}$ @100 kgf/cm$^2$ | $T_{pc}$ @10 kgf/cm$^2$ | $\Delta T_{pc}$ (10 kgf/cm$^2$ – 100 kgf/cm$^2$) |
| 1 | 79% DST/21% SYLVARES ™ TR A25 (from Example 1) | 72.5 | 15.7 | 6.5 | 38 | 73 | 35 |
| 2 | 46:46:8 wt % ratio of amorphous resin A:amorphous resin B:crystalline resin C C12:C9 qcid; diol CPE (from Example 1) | 7 | 22.9 | 10.4 | 100 | 100 | 0 |
| 3 | C12:C9 acid:diol CPE | 71 | 22.9 | 10.4 | 73 | 73 | 0 |
| 4 | 79:21 C12:C3/SYLVARES ™ TR A25 | 63 | 13.4 | 6.6 | 54 | 63 | 9 |
| 5 | 79:21 C12:C6/SYLVARES ™ TR A25 | 72 | 14.3 | 6.1 | 53 | 70 | 17 |
| 6 | 79:21 C12:C9/SYLVARES ™ TR A25 | 71 | 22.9 | 10.4 | 54 | 69 | 15 |
| 7 | 70:30 C12:C6/SYLVARES ™ TR A25 | 72 | 15.7 | 6.5 | 45 | 70 | 25 |
| 8 | 60:40 C12:C6/SYLVARES ™ TR A25 | 72 | 15.7 | 6.5 | 37 | 70 | 33 |
| 9 | 50:50 C12:C6/SYLVARES ™ TR A25 | 72 | 15.7 | 6.5 | 29 | 64 | 35 |
| 10 | 70:30 C12:C6/SYLVATAC ® RE 25 | 72.6 | 16.9 | 7.6 | 45 | 62 | 17 |
| 11 | 70:30 C12:C6/SYLVALITE□ RE 10L | 72.6 | 16.9 | 7.6 | 40 | 63 | 23 |
| 12 | 70:30 C12:C6/SYLVALITE ® RE 10L | 72.7 | 17.0 | 7.5 | 26 | 57 | 31 |

As shown in samples 7 to sample 12 increasing the amount of amorphous small molecule lowers the high pressure transition temperature further. The low pressure transition is not greatly affected by the addition of amorphous resin, the transition temperature at low pressure remains close to the CPE melt-point, so it is possible to reduce the high pressure transition temperature, while leaving the low pressure temperature high enough for good blocking.

There are some important advantages to using the CPE resin for the CPF toner, rather than a small molecule crystalline material. Because CPE is a polymer, compared to the DST small molecule, there is an increased toughness and elasticity, which could be very important to produce a robust toner particle.

Moreover, because CPE resins have been previously designed for emulsion aggregation (EA) toner control the acid number to get the required acid value is well known.

Adjusting the acid value of a small molecule crystalline material is not as straightforward.

Since the DST is a small molecule putting an acid group in every molecule would make the acid value much too high to make toner. So only a small number of the DST molecules for example could potentially have an acid group, to enable making a functional EA toner—acid number affects both toner making and toner performance in charging. Also, one of the easiest ways to add an acid group to the DST small molecule for example is to have only one stearate group and have the other functional group of the terephalate as a free acid group. However, this would change the melt and baroplastic behavior of those monostearyl terephalate acid molecules compared to those with DST. Another small molecule could be added with acid groups, but again this could impact baroplastic performance. These issues do not arise with the polymeric CPE.

Example 3-Toner Production

Latex Preparation:

A latex of 190 nm size was prepared by co-emulsification of a 79/21 ratio of C10/C6 CPE (AV=10.2) and SYLVARES™TR A25 (AV=0). 79 grams of C10/C6 CPE resin and 21 g of SYLVARES™TR A25 were measured into a 2 liter beaker containing about 1000 grams of ethyl acetate. The mixture was stirred at about 300 revolutions per minute at 65° C. to dissolve the resin and CCA in the ethyl acetate. 6.38 grams of Dowfax (47 wt %) was measured into a 4 liter glass beaker containing about 1000 grams of deionized water. Homogenization of said water solution in said 4 liter glass beaker was commenced with an IKA Ultra Turrax T50 homogenizer at 4,000 revolutions per minute. The resin mixture solution was then slowly poured into the water solution as the mixture continues to be homogenized, the homogenizer speed is increased to 8,000 revolutions per minute and homogenization is carried out at these conditions for about 30 minutes. Upon completion of homogenization, the glass flask reactor and its contents are placed in a heating mantle and connected to a distillation device. The mixture is stirred at about 250 revolutions per minute and the temperature of said mixture is increased to 80° C. at about 1° C. per minute to distill off the ethyl acetate from the mixture. Stirring of the said mixture is continued at 80° C. for about 120 minutes followed by cooling at about 2° C. per minute to room temperature. The product is screened through a 25 micron sieve. The resulting resin emulsion is comprised of about 13.84 percent by weight solids in water, and has a volume average diameter of about 196.2 nanometers as measured with a HONEYWELL MICROTRAC® UPA150 particle size analyzer. Two further latexes were also prepared in a similar manner, except that 70 grams of C10/C6 CPE resin with 30 g of SYLVARES™TR A25 were used to prepare latex with 183.1 nm size at 17.52 wt % solid content, and 70 grams of C10/C6 CPE resin with 30 g of SYLVATAC□RE25 were used to prepare another latex of 139.6 nm size at 17.44 wt % solid content.

Toner Preparation A:

Into a 2 liter glass reactor equipped with an overhead stirrer was added 33.95 g PB15:3 dispersion (17.89 wt %), and 726.26 g above latex with 79 grams of C10/C6 CPE resin and 21 g of SYLVARES™TR A25. Above mixture had a pH of 3.71, then 20.17 grams of $Al_2(SO_4)_3$ solution (1 wt %) was added as flocculent under homogenization. The temperature of mixture increased to 55° C. at 250 rpm. The particle size was monitored with a Coulter Counter until the core particles reached a volume average particle size of 7.42 μm. Thereafter, the pH of the reaction slurry was increased to 9.5 using 15.81 g EDTA (39 wt %) and NaOH (4 wt %) to freeze the toner growth. After freezing, the reaction mixture was heated to 70° C. The toner was quenched after coalescence, and it had a final particle size of 9.64 microns. The toner slurry was then cooled to room temperature, separated by sieving (25 μm), filtration, followed by washing and freeze dried.

Toner preparation B: Into a 2 liter glass reactor equipped with an overhead stirrer was added 34.18 g PB15:3 dispersion (17.89 wt %), and 577.61 g (17.52 wt %) latex with C10/C6 CPE to SYLVARES™TR A25 at a ratio of 70 to 30. Above mixture had a pH of 3.70, then 56.15 grams of $Al_2(SO_4)_3$ solution (1 wt %) was added as flocculent under homogenization. The temperature of mixture was increased to 60.5° C. at 250 rpm. The particle size was monitored with a Coulter Counter until the core particles reached a volume average particle size of 6.48 μm. Thereafter, the pH of the reaction slurry was increased to 9.5 using 13.08 g EDTA (39 wt %) and NaOH (4 wt %) to freeze the toner growth. After freezing, the reaction mixture was heated to 67.9° C. The toner was quenched after coalescence, and it had a final particle size of 8.24 microns. The toner slurry was then cooled to room temperature, separated by sieving (25 μm), filtration, followed by washing and freeze dried.

Toner preparation C: Into a 2 liter glass reactor equipped with an overhead stirrer was added 38.70 g PB15:3 dispersion (16.00 wt %), and 571.97 g latex with C10/C6 CPE to SYLVATAC® RE25. Above mixture had a pH of 4.07, then 61.71 grams of $Al_2(SO_4)_3$ solution (1 wt %) was added as flocculent under homogenization. The temperature of mixture was increased to 60.8° C. at 250 rpm. The particle size was monitored with a Coulter Counter until the core particles reached a volume average particle size of 6.75 μm. Thereafter, the pH of the reaction slurry was increased to 9.01 using NaOH (4 wt %) to freeze the toner growth. After freezing, the reaction mixture was heated to 68° C. The toner was quenched after coalescence, and it had a final particle size of 7.90 microns. The toner slurry was then cooled to room temperature, separated by sieving (25 μm), filtration, followed by washing and freeze dried.

Table 7 shows the Shimadzu phase change transition temperature difference is not as large in the toner samples as it is in the simple mixtures of the CPE and small amorphous molecule in Table 6. For example in Table 6 the Sample 5 mixture with 79/21 ratio of CPE C10:C6/SYLVARES™ TR A25 had a shift with pressure of 17° C. to transition temperature of 53° C. at 100 kgf/cm$^2$, compared to toner sample A with a shift with pressure of 3° C. to transition temperature of 68° C. at 100 kgf/cm$^2$. Also in Table 6 the Sample 1 mixture with 70/30 ratio of CPE C10:C6/SYLVARES™ TR A25 had a shift with pressure of 25° C. to transition temperature of 45° C. at 100 kgf/cm$^2$, compared to toner sample B with a shift with pressure of 4° C. to transition temperature of 68° C. at 100 Kgf/cm$^2$, Also in Table 6 the Sample 10 mixture with 70/30 ratio of CPE C10:C6/SYLVATAC® RE40 had a shift with pressure of 17° C. to transition temperature of 45° C. at 100 kgf/cm$^2$, compared to toner sample C with the same formulation with a shift with pressure of 7° C. to transition temperature of 62° C. at 100 kgf/cm$^2$, As shown in Table 7 reduction in the phase transition temperature and the increase in the shift with pressure can be achieved with further increase in amorphous content.

TABLE 7

| Toner Sample | Material ID | CPE Properties Mn (k) | Mw (k) | Mp (° C.) | Phase ChangeTransition Temperature (° C., $10^4$ Pa-s) 100 kgf/cm$^2$ | 10 kgf/cm$^2$ | ΔT (° C.) 10 – 100 kgf/cm$^2$ |
|---|---|---|---|---|---|---|---|
| A | 79/21 C12:C6/ SYLVARES ™ TR A25 | 25.6 | 10.7 | 75.5 | 68 | 71 | 3 |
| B | 70/30 C12:C6/ SYLVARES ™ TR A25 | 25.6 | 10.7 | 75.5 | 65 | 69 | 4 |
| C | 70/30 C12:C6/ SYLVATAC ® RE25 | 16.9 | 7.6 | 72.6 | 62 | 69 | 7 |

What is claimed is:

1. A latex formed from a cold pressure fix toner composition comprising:

at least one $C_{16}$ to $C_{80}$ crystalline organic material having a melting point in a range from about 30° C. to about 130° C.; and at least one $C_{16}$ to $C_{80}$ amorphous organic material having a $T_g$ of from about −30° C. to about 70° C.

2. The latex of claim 1, wherein the at least one crystalline organic material comprises a crystalline polyester, or a crystalline ester.

3. The latex of claim 1, wherein the at least one crystalline organic material comprises a crystalline ester selected from the group consisting of

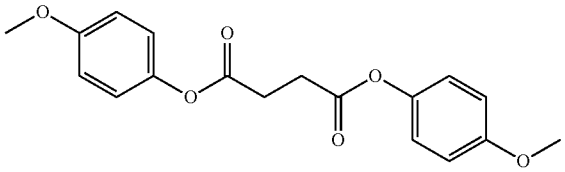

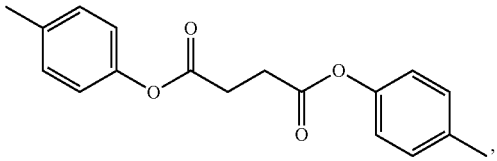

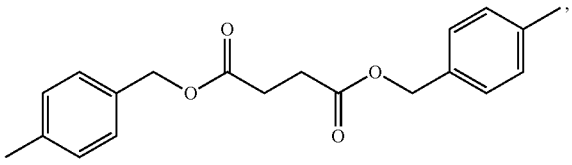

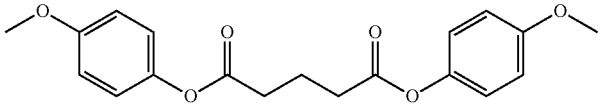

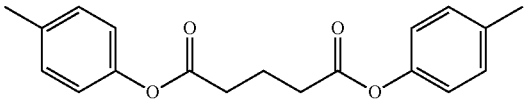

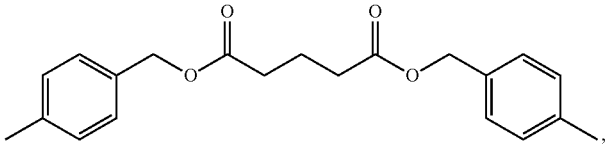

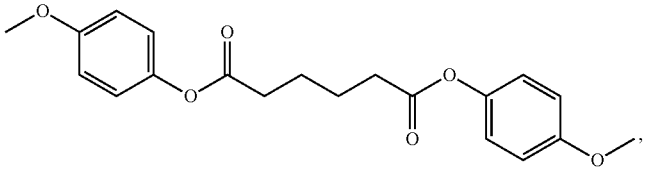

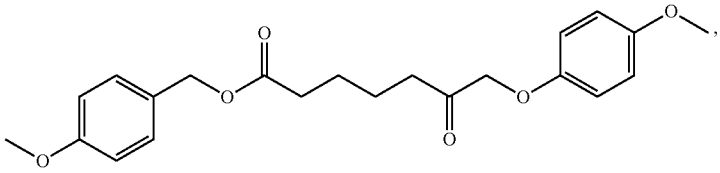

-continued
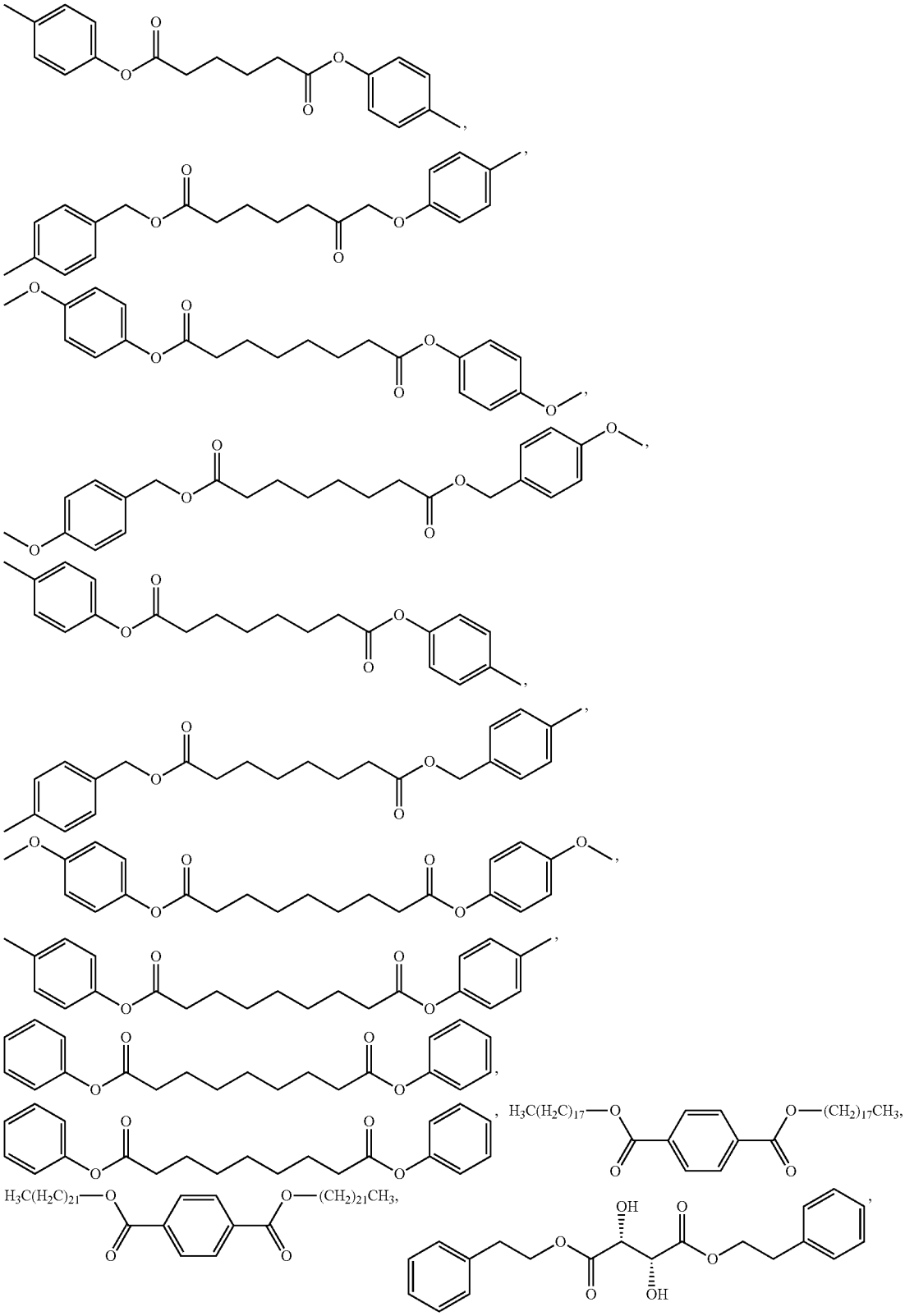
and mixtures thereof.
4. The latex of claim 1, wherein the crystalline ester is selected from the group consisting of

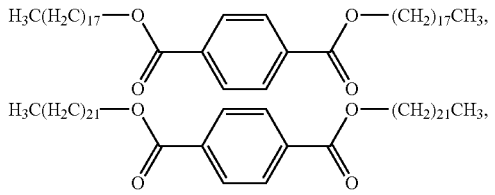

and mixtures thereof.

5. The latex of claim 1, wherein the number average molecular weight Mn of the crystalline organic material is from about 300 to about 1200, and a weight average molecular weight Mw is from about 300 to about 2,000.

6. The latex of claim 1, wherein the at least one amorphous organic material is an optionally hydrogenated rosin ester or a modified rosin ester.

7. The latex of claim 6, wherein the optionally hydrogenated rosin ester or the modified rosin ester comprises a mono-, di-, or tri-tetra-ester.

8. The latex of claim 1, wherein the at least one amorphous material is selected from the group consisting of styrenated terpenes, polyterpenes, terpene phenolics, and mixtures thereof.

9. The latex of claim 1, wherein the at least one amorphous material is an optionally hydrogenated hydrocarbon resin based on aliphatic C5 monomers or aromatic C9 monomers.

10. The latex of claim 1, wherein the number average molecular weight Mn of the amorphous organic material is from about 300 to about 1200, and the weight average molecular weight Mw is from about 300 to about 2,000.

11. The latex of claim 1, wherein the amorphous organic material having an acid number of about 0 to about 300.

12. The latex of claim 1, further comprising an acid functionality on the at least one crystalline organic material, and/or the at least one amorphous organic material.

13. The latex of claim 9, wherein the acid functionality is incorporated as a monoester of a diacid.

14. The latex of claim 1, wherein the weight ratio of the crystalline organic material to the amorphous organic material is from about 50:50 to about 95:5.

15. The latex of claim 1, wherein the temperature required to lower viscosity to $10^4$ Pa-s of the cold pressure fix toner at a pressure of 100 kgf/cm$^2$ is from about 15° C. to about 70° C.

16. The latex of claim 1, wherein the temperature required to lower viscosity of the cold pressure fix toner to about $10^4$ Pa-s at a pressure of 10 kgf/cm$^2$ is from about 50° C. to 90° C.

17. The latex of claim 1, wherein the temperature shift from 10 to 100 kgf/cm$^2$ of the cold pressure fix toner to lower the viscosity to $10^4$ Pa-s is in a range from about 10° C. to about 60° C.

18. The latex of claim 1, prepared by phase inversion emulsification.

19. A latex formed from a cold pressure fix toner composition comprising:

a crystalline organic material comprising:

(1) a crystalline polyester; or (2) a crystalline ester;

wherein the crystalline organic material has a melting point in a range from about 30° C. to about 130° C.; and an amorphous organic material comprising:

(a) a rosin ester;

(b) styrenated terpenes, polyterpenes, or terpene phenolics; or (c) a hydrogenated hydrocarbon resin derive from a 5 carbon aliphatic monomer or 9 carbon aromatic monomer;

wherein the amorphous organic material having a $T_g$ of from about −30° C. to about 70° C., and the number average molecular weight Mn of the amorphous organic material is from about 300 to about 1200, and the weight average molecular weight Mw is from about 300 to about 2,000.

20. A latex formed from a cold pressure fix toner composition comprising:

a crystalline organic material comprising:

(1) a crystalline polyester; or (2) a crystalline ester;

wherein the crystalline organic material has a melting point in a range from about 30° C. to about 130° C.; and an amorphous organic material comprising:

(a) a rosin ester;

(b) styrenated terpenes, polyterpenes, or terpene phenolics; or (c) a hydrogenated hydrocarbon resin derive from a 5 carbon aliphatic monomer or 9 carbon aromatic monomer;

wherein the amorphous organic material having a $T_g$ of from about −30° C. to about 70° C., and the number average molecular weight Mn of the amorphous organic material is from about 300 to about 1200, and the weight average molecular weight Mw is from about 300 to about 2,000;

further wherein the temperature required to lower viscosity to $10^4$ Pa-s of the cold pressure fix toner at a pressure of 100 kgf/cm$^2$ is from about 15° C. to about 70° C., and wherein the temperature required to lower viscosity of the cold pressure fix toner to about $10^4$ Pa-s at a pressure of 10 kgf/cm$^2$ is from about 50° C. to 90° C., and wherein the temperature shift from 10 to 100 kgf/cm$^2$ of the cold pressure fix toner to lower the viscosity to $10^4$ Pa-s is in a range from about 10° C. to about 60° C.

* * * * *